United States Patent [19]

Mintz

[11] 3,942,801

[45] Mar. 9, 1976

[54] GOLF GAME APPARATUS

[76] Inventor: Nathan Louis Mintz, 10612 Cavalier Drive, Silver Spring, Md. 20901

[22] Filed: Sept. 9, 1974

[21] Appl. No.: 504,360

[52] U.S. Cl. .... 273/176 AB; 273/176 B; 273/176 F

[51] Int. Cl.[2] ..... A63B 69/36; A63B 67/02

[58] Field of Search ..... 273/176 B, 178 B, 182 A, 273/176, 35, 56, 57, 87, 87.2, 87.4

[56] References Cited

UNITED STATES PATENTS

| | | | |
|---|---|---|---|
| 610,336 | 9/1898 | White | 273/176 B |
| 3,084,941 | 4/1963 | Anthony | 273/56 X |
| 3,260,527 | 7/1966 | Younce | 273/182 A X |
| 3,809,404 | 5/1974 | Fikse | 273/176 B |

*Primary Examiner*—George J. Marlo

[57] ABSTRACT

A golf game having adjustable boundaries and obstacles and having an adjustable end member or green provided with a ballreceiving cup. The ball is moved on the course by kicking.

5 Claims, 4 Drawing Figures

GREEN
SAND TRAP
WATER HAZARD
ROUGH
ROUGH
FAIRWAY
KICK-OFF LINE

GOLF GAME APPARATUS

This invention relates to a golf game having adjustable boundaries and obstacles and an adjustable end member or green provided with a cup and wherein the ball is moved on the course by kicking.

The game of golf is usually played outdoors with a set of matching clubs, either on a private,or a public golf course. With the present invention, play can be either indoors or outdoors, and clubs are not required since the player uses his foot to propel the ball along the course.

Instead of employing fixed boundaries as in ordinary golf, with the present invention the boundaries for the game are readily adjustable in order to provide variety of play. The present invention also includes obstacles which can be moved to different locations.

Further objects and advantages of the present invention will become apparent from the following description and claims, and from the accompanying drawings, wherein:

Figures 1, 2, 3, 4:
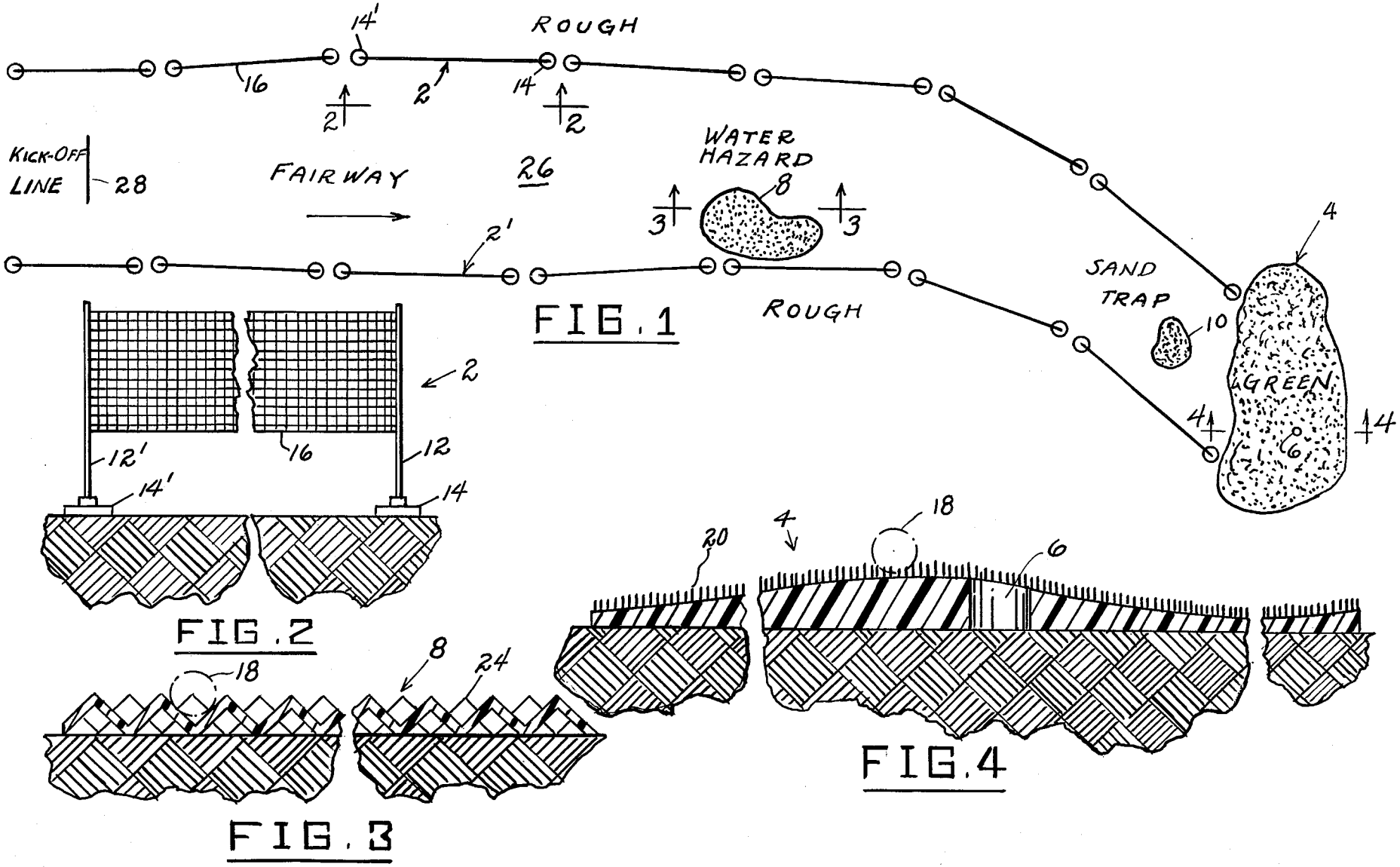
FIG. 1 is a plan view of a course according to the present invention.
FIG. 2 is an enlarged elevational view taken substantially on line 2—2 of FIG. 1.
FIG. 3 is an enlarged sectional view taken substantially on line 3—3 of FIG. 1.
FIG. 4 is an enlarged sectional view taken substantially on line 4—4 of FIG. 1.

Referring to FIG. 1, a portable variable miniature golf course is shown having a series of boundary members 2,2'. These may be moved toward one another to make the course narrower and thus more difficult to play. Should the ball be kicked off the course beyond the boundary members, either under or over the same, one stroke is added to the player's score to return the ball on course at its point of exit. Details of boundary members 2,2' are shown in FIG. 2, wherein short poles 12,12' are mounted on movable bases 14,14' the support an elevated net 16 so that a ball can pass thereunder. Other boundary members may be used within the scope of the present invention, such as short sections of wire fencing about three to six inches in height, if desired.

End member or green 4 has an opening 6 to receive the golf ball. Hazards 8, 10 may be placed wherever desired on the course, of penalty of one stroke being added to the player's score if the ball comes to rest on the hazard.

Referring to FIG. 3, obstacle 8 comprises a mat, preferably blue in color to represent water, having projections 24 thereon to trap a ball. The projections may comprise upwardly directed pyramid-shaped protrusions. The mat may also be smooth, as a modification, provided with a slight depression to retain the ball. Obstacle 10 may be similar to obstacle 8, but colored brown to represent a sand trap.

Referring to FIG. 4, end member or green 4 is a portable mat of irregular shape having a plurality of projections 20 which may be of unequal height. The projections may comprise upstanding fibers, as shown. Artificial grass mats are suitable for this purpose. The top surface of the mat preferably has a curving configuration.

Returning to FIG. 1, the positions of members 2,2' determine the width of fairway 26 and these members may be positioned so as to make the fairway as tortuous as desired. From kick-off line 28 until the ball is kicked into opening 6, each kick counts as one stroke. Strokes are added when the ball is kicked off the course or stops on a hazard; the ball can then be placed back on the fairway.

While a specific embodiment of an improved portable golf game has been disclosed in the foregoing description, it will be understood that various modifications within the spirit of the invention may occur to those skilled in the art. Therefore, it is intended that no limitations be placed on the invention except as defined by the scope of the appended claims.

I claim:

1. Apparatus for playing a game of golf wherein the golf ball is moved over a playing surface by kicking same comprising a golf ball, a plurality of portable boundary forming members adapted to be positioned on a playing surface to define the boundaries of a golf course fairway, each of said boundary forming members including an elongated lightweight panel having a predetermined length and height for forming an elevated elongated barrier to said ball, a base member adapted to rest on a playing surface, means for supporting said panel on said base member in an elevated position thereon so that when said base member is resting on a playing surface, said elongated panel member extends generally perpendicular to said playing surface and a lower elongated edge of said panel member is positioned at a generally uniform distance from said playing surface, said distance being such that said golf ball, when rolling on said surface, may pass under said panel at substantially any location along the length thereof for affecting the score of the player, and the height of said panel being such that said golf ball may be kicked from a playing surface over said panel by a player for also affecting the score of a player, and a portable mat simulating the appearance of a golf green and including an opening in the upper surface thereof for receiving said ball.

2. The apparatus defined in claim 1, wherein said mat is of irregular shape and has an artificial grass surface.

3. The apparatus defined in claim 1, including at least one artificial hazard for placement in a fairway, said hazard comprising a movable mat having means to retain said ball thereon.

4. The apparatus defined in claim 3, wherein said means to retain said ball on the hazard mat is a recess in the upper surface thereof.

5. The apparatus defined in claim 3, wherein said means to retain said ball comprises a plurality of pyramid-shaped projections on the upper surface of said hazard mat.

* * * * *